United States Patent [19]

Glucksman et al.

[11] Patent Number: 4,819,353

[45] Date of Patent: Apr. 11, 1989

[54] ILLUMINATED PICTURE FRAME

[76] Inventors: Dov Z. Glucksman, 137 Larch Row, Wenham, Mass. 01984; Paul K. Cohen, 23 Fifer Ln., Lexington, Mass. 02173; Jorg Ratzlaff, 617 Hudson St., New York, N.Y. 10014

[21] Appl. No.: 79,956

[22] Filed: Jul. 31, 1987

[51] Int. Cl.[4] ..... G09F 13/18; A47G 1/06

[52] U.S. Cl. ..... 40/152.2; 40/546

[58] Field of Search ..... 40/152.2, 546, 564, 40/204, 205; 446/484, 485, 439; 362/31

[56] References Cited

U.S. PATENT DOCUMENTS

| | | | |
|---|---|---|---|
| 1,229,044 | 6/1917 | Davis | 40/152.2 |
| 1,348,957 | 8/1920 | Pope | 40/152.2 |
| 1,939,733 | 12/1933 | Strohacker | 446/439 |
| 2,647,834 | 8/1953 | Rabkin et al. | 40/152 |
| 2,724,769 | 11/1955 | D'Arbeloff | 362/31 |
| 3,205,600 | 9/1965 | Snyder | 40/152.2 |
| 3,226,866 | 1/1966 | De Poray | 40/152.2 |
| 3,464,133 | 9/1969 | De Poray | 40/152.2 |
| 3,517,937 | 6/1970 | Glass et al. | 40/152.2 |
| 3,531,891 | 10/1970 | Goldfarb et al. | 446/485 |
| 3,684,882 | 8/1972 | Mininno et al. | 40/546 |
| 4,221,454 | 9/1980 | Wong | 446/484 |
| 4,282,669 | 8/1981 | Rievmont | 40/152.2 |
| 4,475,298 | 10/1984 | Munoz | 40/546 |
| 4,507,884 | 4/1985 | Kazanjian | 40/152.2 |
| 4,674,211 | 6/1987 | Pratt | 40/152.2 |
| 4,697,365 | 10/1967 | Moosbrugger | 40/546 |

*Primary Examiner*—Paul J. Hirsch

*Attorney, Agent, or Firm*—Leydig, Voit & Mayer

[57] ABSTRACT

An illuminated picture frame is in the shape of an open box provided with two rows of spaced incandescent, small bulbs arranged on opposite sides of a picture attached to the rear wall of the box. The bulbs on each side are positioned in the apex of a reflector of parabolic cross section, the axis of which is directed towards the picture surface. Fixation of each bulb is in longitudinally slotted bushings extending from the reflector's rear side, permitting the adjustment of each bulb filament in the focus of the parabola. Two bare wire conductors are fastened on the rear side of the reflector, and the terminals of each bulb are soldered to these conductors. One or more batteries are located in a housing on the outside of the rear wall and are connected to the conductors by means of switch.

2 Claims, 2 Drawing Sheets

ILLUMINATED PICTURE FRAME

BACKGROUND OF THE INVENTION

The invention relates to pictures and photographs enclosed in a frame which can be artificially lighted whenever a person wishes to view the subjects of a picture in more detail. It relates particularly to pictures in frames placed on a desk or mantlepiece in either horizontal or vertical orientation.

Framed pictures are usually lighted externally and/or independently by means of room lighting and/or by closely positioned or attached fixtures. In practice, the added fixtures are most often applied since room lighting is insufficient, but invariably as a compromise in lighting efficiency and effect. Therefore, it has been tried in the past to incorporate such lighting fixtures inside the picture frame itself, while concealing the light source from the viewer's eyes, with the intention of illuminating the picture but not the frame. In this manner an effect of depth is created and the individual details of the picture are well elaborated.

Illuminated picture frames have been designed and patented in the past. They are characterized by the use of elongated light bulbs or fluorescent tubes placed into a channel inside one or more sides of the picture frame, the channel being open on the frame inside so as to direct the light rays onto the picture surface. While U.S. Pat. No. 2,220,262 (Miller) discloses a frame provided with a tubular light bulb positioned along one side of the frame directing the light rays onto the surface of the inclined picture in order to light most of its surface by this unidirectional light source, the majority of the disclosures describe positioning of elongated light sources along two or even four sides of the picture frame, with improved lighting effects. The main drawback of the existing illuminated frames is the large volume and weight of the light sources and fittings, which require broad and heavy frame profiles and therefore limit their use to wallhung pictures, since they require connection to the electric supply system. None of the known illuminating means and fixtures are suitable for a movable picture frame to be placed on a desk or a mantlepiece or a book shelf.

Recently an ever-increasing demand for illuminated standing frames has led to the present design of a light and portable frame, since people love to view the pictures of their friends, relatives, or dearly departed ones in full color and well lighted. For this reason, it is the object of the present invention to provide such picture frame of lightweight and supplied with its own long-lasting electric energy source.

It is another object to provide such picture frames with narrow profiles, especially with respect to frames surrounding photographs of relatively small size, where broad and heavy frames would be inproportional.

Another object is to permit ready exchange of pictures of the illuminating fixtures and to give ready access to the interior for the purpose of cleaning the light fixtures, the picture surface, and the glass pane.

It is a final object to provide such picture frames at low cost by standardization of sizes and by mass manufacture of the various components.

SUMMARY OF THE INVENTION

An illuminated picture frame according to the invention is in the shape of an open box comprising a rear wall, means for fastening a picture to the rear wall, four side walls attached to the rear wall and provided with extending frontal rim portions of a width leaving a frontal opening co-extensive with the size of the picture.

The illuminating fixtures are positioned along at least two side walls and are covered by the sidewall rims so as not to be visible to the viewer. Each fixture is in the shape of a bar of a dielectric material forming a linear reflector of uniform curvature throughout directed towards the picture surface. The reflector, which is preferably of parabolic cross section, is provided with a light-reflecting surface produced, for instance, by metal plating. A plurality of small light bulbs are fastened to the bar in substantially equidistant alignment, each with its filament positioned in or close to the focal point of the reflector curve.

The terminals of each bulb are attached to two conductors fastened to said reflector bar, and a switch is provided on the outside of the box, permitting the picture to be illuminated as long as a person wishes.

In a preferred embodiment the bulbs are of cylindrical shape and are held in longitudinally slotted bushings extending from the apex of the reflector in rearward direction, permitting the focal alignment of each filament.

The axis of the reflector curve and of the bulbs is preferably inclined towards the picture surface, at an angle ensuring substantially uniform illumination, especially since illuminating fixtures are mounted along two sides of the picture. In case only two illuminating fixtures are provided, they are preferably mounted along the long sides of the frame.

In order to protect the picture from being touched, the front opening of the box is covered by a glass pane which is held in position by an additional outer frame with rounded corners serving to improve the appearance of the picture frame. The outer frame as well as the glass pane are readily removable to permit cleaning of the interior or exchanging the picture and/or the illuminating fixtures, should this become necessary.

With a view to providing the portability of the picture frame, the electricity supply is incorporated in the form of one or more batteries which may be rechargeable or be discarded after depletion. They are housed in a casing attached to the rear of the main box, and a rear support is preferably attached to the casing in a manner permitting both vertical or horizontal positioning of a picture.

DETAILED DESCRIPTION OF THE DRAWINGS

Figure 4:
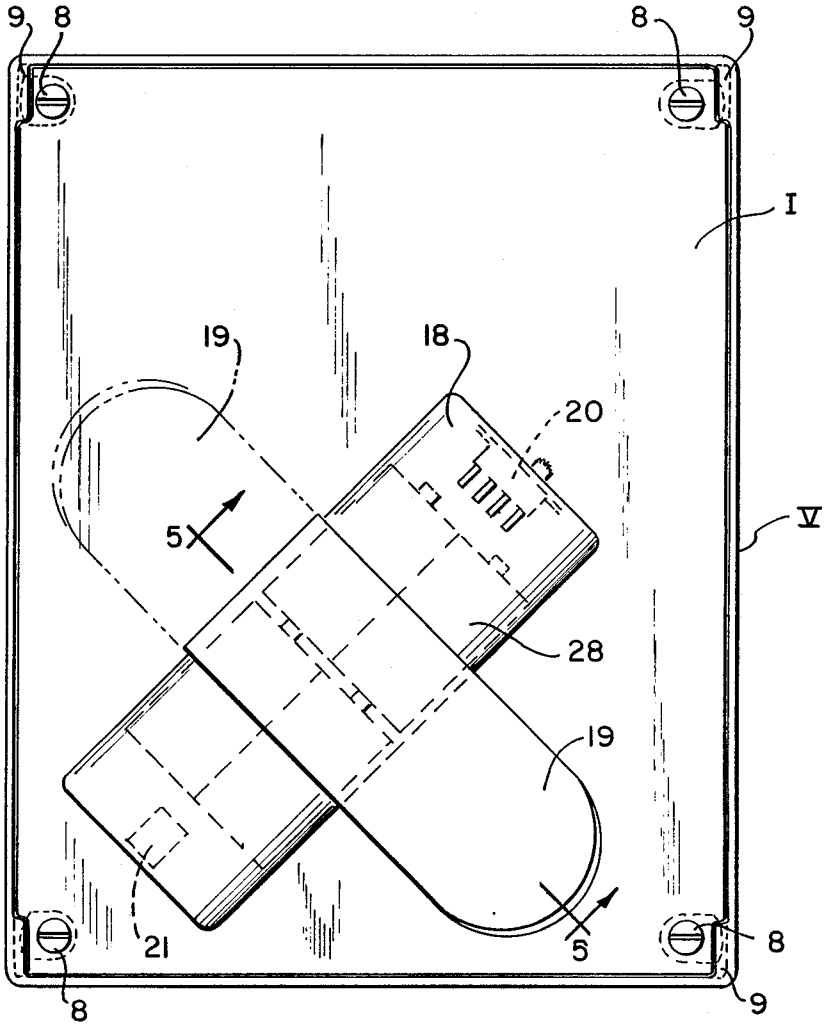
FIG. 4 is a rear view of the illuminated picture frame showing the battery storage case and the support leg.
Figure 1:
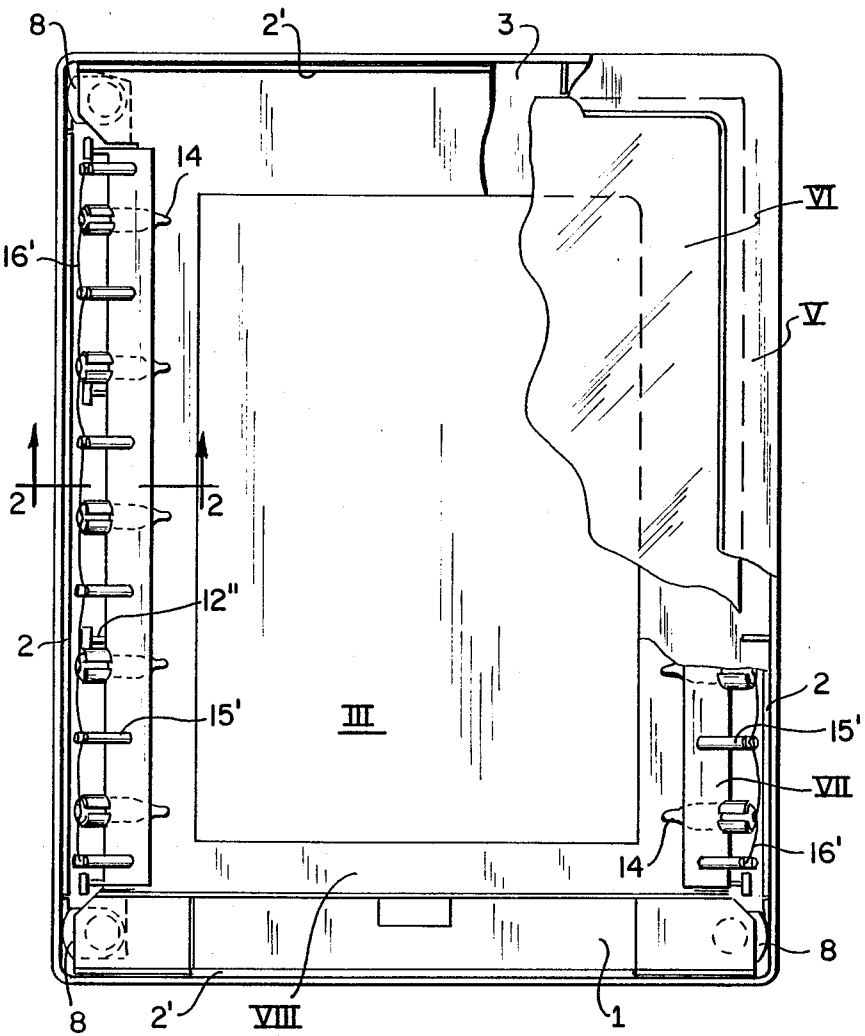
FIG. 1 is an elevation of an illuminated picture frame showing one corner covered by a glass pane, while the main part is shown in section in order to illustrate the illuminating fixtures in detail.
Figure 2:
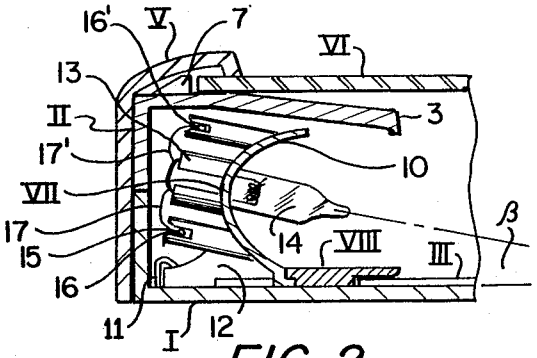
FIG. 2 is a section along line 2—2 of FIG. 1 at an enlarged scale.
Figure 7:
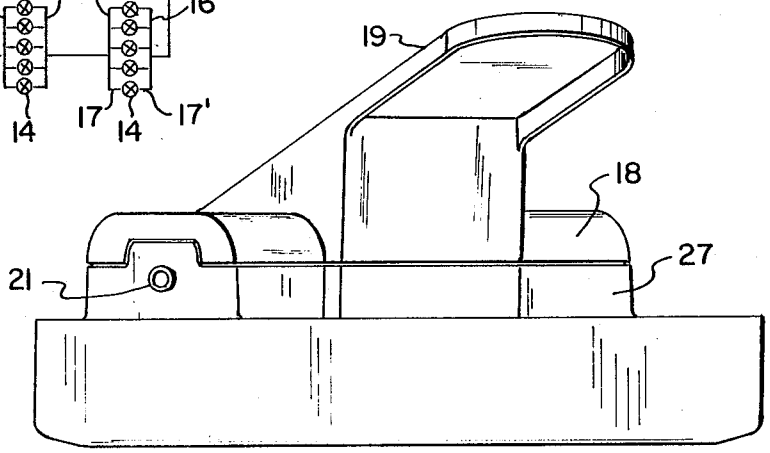
FIG. 7 is a bottom view of the illuminated picture frame showing the back side of the support leg.
Figure 6:
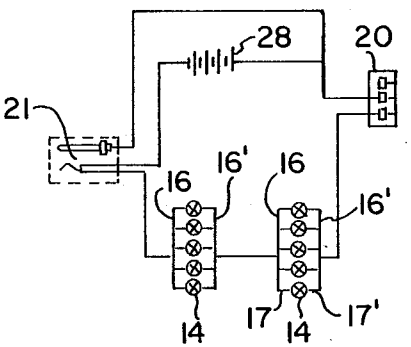
FIG. 6 is a wiring diagram of the illuminated picture frame.
Figure 5:
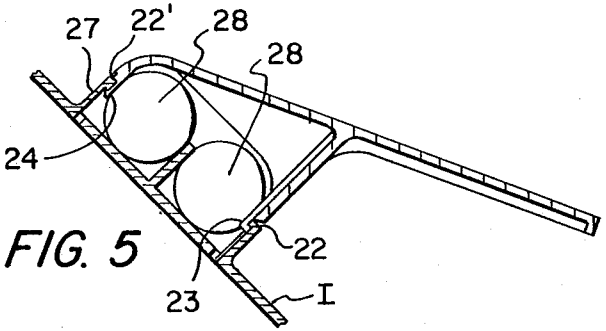
FIG. 5 is a section along line 5—5 of FIG. 4 showing the integral locks holding the battery case cover in place.
Figure 3:
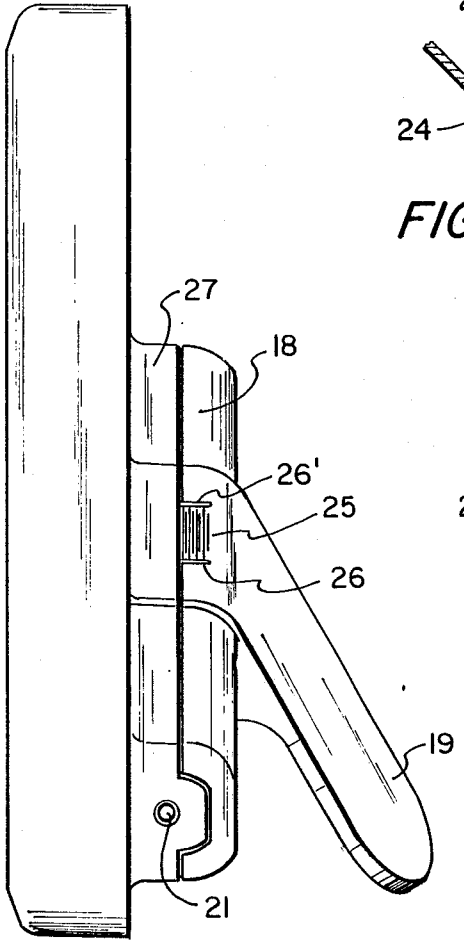
FIG. 3 is a side view of the illuminated picture frame showing a battery storage casing and a support leg.

The illuminated picture frame illustrated in FIGS. 1 through 6 comprises a rear housing I, consisting of a back wall 1 and two pairs of side walls 2, 2', and a front housing II with an inwardly extending rim 3. The rim extends far enough in inward direction to cover the illuminating fixtures VII and forms a rectangular opening coextensive with the size of a picture III which is placed flat on the rear wall 1 and held there by a rectangular retaining frame VIII. A glass pane VI covers the opening and is held in position by forward extending ridges 7 provided along rim 3 and by an outer frame V, which also covers the side walls 2, 2'. The outer frame V has rounded corners for decorative purposes and may be otherwise ornamented; it is fastened to the rear housing I by four rotating flat cams 8, which engage inwardly extending tabs 9 which are an integral part of the outer frame V. The outer frame can be readily removed by turning the cams until they disengage the tabs. Removing the outer frame gains access to the inside of the box for the purpose of cleaning the glass, the picture or for the replacement of the fixture in the event one burned out.

The drawings show two illuminating fixtures extending along the two long sides of the frame, but it will be understood that similar fixtures could be provided along the short sides as well.

Each illuminating fixture VII comprises a bar of molded plastic dielectric material somewhat shorter than the respective side wall and is in the form of a curved reflector surface 10 of uniform, preferably parabolic, cross-section throughout. The reflector surface is made highly light-reflective by metal plating and its axis is inclined in downward direction forming an acute angle $\beta$ with the picture surface III. The fixture is held in its position by means of the retaining frame VIII on the one hand and by several hook-shaped projections 11 on the other, both engaging with several supports 12 formed on the side remote from the reflector surface. The bar is perforated along the reflector axis by a number (five in the drawing) of sockets 13 serving to grip and secure cylindrical light bulbs 14. The sockets are in the form of equidistantly spaced, slotted bushings 13 extending rearwardly of the reflector surface and permitting longitudinal shifting of each bulb until the position of its filament coincides with the focal point of the reflector curve. In addition to the sockets 13, a number of slotted posts 15 and 15' protrude rearwardly from the fixture bar in spaced-apart alignment and carry two bare electric conductor wires 16 and 16'. The filament wires protruding out of the rear of the bulbs (17 and 17') are conductively connected to the wires 16, 16', respectively, e.g., by soldering, whereby all bulbs in one fixture are connected in parallel.

The conductor wires 16 and 16' are conductively connected to one or more batteries 28 which are located in a battery housing 27 and a battery housing cover 18. A switch 2 on the outside of the battery housing serves to illuminate the picture by closing the battery circuit.

The battery casing is also provided with a coaxial jack 21 intended to receive a coaxial plug conducting power from an external low voltage power supply, not shown.

A support leg 19 serves to hold the frame standing on a horizontal surface, such as a table, in slightly rearward inclination.

The support leg 19 which is an integral part of the battery housing cover 18 is symmetrical, with its line of symmetry running along the center of the support leg. Thus, the battery cover 18 can be placed over the battery housing with the support leg 19 extending either toward the short wall (as shown in solid lines in FIG. 4) or the long wall of the outer frame V (as shown in dotted lines in FIG. 4), permitting the frame to be placed in a horizontal or vertical position.

The battery housing 27 is provided with two short inwardly orientated ribs 22, 22' which engage two hooks which are integral parts of the cover 18. One hook 23 being rigid acts as a hinge point in conjunction with the rib 22, whereas the second hook 24 is part of free extended leaf 25 which is separated from the rest of the cover by two slots 26, 26'. When the leaf is pressed inwardly, the hook 24 will disengage from the rib 22' and the cover could be removed to replace the batteries or to reorient the picture frame.

The inside of the rim 3 is matte, non-reflecting with a view to preventing irregular lighting of the picture III.

It will be understood that the shape of the frame and of the illuminating fixtures as illustrated in the accompanying drawings may undergo various changes and modifications in order to suit these for various applications and tastes; however, such modifications should be within the spirit of the invention and the scope of the appended claims.

The type of bulbs shown and described and their connection to the fixture bar have been chosen since they permit focal adjustment of the filament, but there may be other types of bulbs and other sockets which may serve the same purpose. Likewise, the shape of the frame box can be altered according to different tastes and likes, but again the shape described lends itself to mass manufacture by injection molding of suitable plastics material.

Finally, instead of employing electric batteries, the frame may be provided with means for attaching it to any domestic electric supply system, with or without a transformer/converter system.

I claim:

1. An illuminated picture frame comprising a housing in the shape of an open box comprising a rear wall, means for fastening a picture to said rear wall, four side walls and an inwardly projecting front rim of a size leaving a frontal opening coextensive with the size of said picture;

at least two illuminating fixtures extending along at least two of said side walls, each said fixture consisting of a bar of a dielectric material comprising a linear reflector of uniformly curved cross section on the side facing said picture, said reflector is inclined toward the surface of said picture, a plurality of spaced-apart bulb sockets and means for holding conductor wires extending along said bar in spaced-apart relationship, both on the side of said bar facing said side wall;

a plurality of light bulbs, one bulb inserted into each said socket and conductively connected to said conductor wires, said sockets are in the form of longitudinally slotted bushings adapted to hold said bulbs by clamping and to permit their placement along said sockets to effect each light filament to coincide with the focus of said curved reflector;

at least one electric battery conductively connected to said conductor wires, said battery(ies) being housed in a battery housing attached to the outside of said rear wall, said battery housing having a cover with an integral support leg serving to keep said frame in a standing position; and switch means adapted to close the circuit containing said battery(ies) and said light bulbs.

2. The illuminated picture frame of claim 1 wherein said battery housing cover with integral support leg is capable of being attached to said battery housing in more than one orientation.

* * * * *